US006273147B1

(12) United States Patent
Herring

(10) Patent No.: US 6,273,147 B1
(45) Date of Patent: Aug. 14, 2001

(54) PAPERMAKING FABRIC SEAM WITH ADDITIONAL THREADS IN THE SEAM AREA

(75) Inventor: Samuel H. Herring, Simpsonville, SC (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 09/384,637

(22) Filed: Aug. 27, 1999

Related U.S. Application Data

(60) Provisional application No. 60/098,547, filed on Aug. 31, 1998, provisional application No. 60/097,831, filed on Aug. 31, 1998, provisional application No. 60/098,566, filed on Aug. 31, 1998, provisional application No. 60/098,567, filed on Aug. 31, 1998, and provisional application No. 60/098,573, filed on Aug. 31, 1998.

(51) Int. Cl.[7] ..... D03D 13/00; D21F 1/00; D21F 7/10

(52) U.S. Cl. ..... 139/383 AA; 442/270; 428/58; 428/193; 162/904

(58) Field of Search ..... 139/383 AA; 442/270; 428/58, 193; 162/904

(56) References Cited

U.S. PATENT DOCUMENTS

| | | | | |
|---|---|---|---|---|
| 3,316,599 | | 5/1967 | Wagner . | |
| 4,186,780 | | 2/1980 | Josef et al. . | |
| 4,438,789 | | 3/1984 | MacBean . | |
| 4,601,785 | | 7/1986 | Lilja et al. . | |
| 4,658,863 | * | 4/1987 | Errecart | 139/383 AA |
| 4,842,925 | | 6/1989 | Dufour et al. . | |
| 4,883,096 | * | 11/1989 | Penven | 139/383 AA |
| 4,979,543 | | 12/1990 | Moriarty et al. . | |
| 5,188,884 | | 2/1993 | Smith . | |
| 5,405,669 | * | 4/1995 | Lidar | 139/383 AA |
| 5,458,161 | | 10/1995 | Scarfe . | |
| 5,476,123 | | 12/1995 | Rydin . | |
| 5,488,796 | * | 2/1996 | Lorenz et al. | 139/383 AA |
| 5,531,251 | | 7/1996 | Rydin . | |
| 5,799,709 | | 9/1998 | Shipley . | |
| 5,913,339 | | 6/1999 | Lee . | |

* cited by examiner

*Primary Examiner*—Andy Falik
(74) *Attorney, Agent, or Firm*—Volpe & Koenig, P.C.

(57) ABSTRACT

An open ended papermaking fabric comprised of interwoven longitudinal and transverse thread systems which define a paper side, a machine side and a plurality of seaming loops at each open end of the fabric. The seaming loops are formed by the longitudinal thread system and the transverse threads define a seaming zone at each end. The fabric is characterized by at least one additional transverse thread interwoven with the longitudinal threads in the seam zone in a repeat pattern that includes a mid-plane float of at least two threads in the longitudinal yarn system.

11 Claims, 8 Drawing Sheets

PAPERMAKING FABRIC SEAM WITH ADDITIONAL THREADS IN THE SEAM AREA

This application claims the benefit of: U.S. Provisional Application Ser. No. 60/098,547, filed Aug. 31, 1998; U.S. Provisional Application Ser. No. 60/097,831, filed Aug. 31, 1998; U.S. Provisional Application Ser. No. 60/098,566, filed Aug. 31, 1998; U.S. Provisional Application Ser. No. 60/098,567, filed Aug. 31, 1998; and U.S. Provisional Application Ser. No. 60/098,573, filed Aug. 31, 1998.

BACKGROUND

The present invention generally relates to an open ended, woven fabric which is designed for use in a papermaking, cellulose or board manufacturing machine. The fabric has a plurality of loops at each end to form a seam for rendering the fabric endless.

As will be known to those skilled in the art, papermaking machines generally include three sections commonly referred to as the forming, press and dryer sections. The present invention finds particular application in the press section of a papermaking machine.

Typically, press felts include a supporting base, such as a woven fabric, and a paper carrying or supporting layer. Frequently, the paper support layer is a homogeneous, non-woven batt that has been affixed to the base. Base fabrics are typically woven fabrics which are used as an endless loop. Such an endless loop fabric may be woven endless with no seam or the fabric may be woven with two ends which are joined by a seam. Typical seams include pin type seams which utilize a pintle inserted through seam loops to close the fabric.

Some prior art seams have employed threads in the seam area to increase batt adhesion. However, these efforts have not always produced the desired contact area or the desired interconnection between paper and machine side machine direction threads.

As a result, there exists a need in seam loop construction to provide increased surface contact in the seam zone for better batt anchorage and a better interconnection between the paper and machine sides.

SUMMARY

The present invention relates to an open ended papermaker's fabric of a type woven from a longitudinal thread system and a transverse thread system. A plurality of seam loops are formed at each end of the fabric by the threads of the longitudinal thread system. A seam zone exists at each end of the fabric between the respective seam loops and the last thread of the transverse thread system. At least one additional transverse thread interwoven in at least one seam zone with the longitudinal thread system in a repeat pattern that includes a mid-plane float that extends between at least two pairs of paper side and machine side longitudinal threads.

DESCRIPTION OF THE PREFERRED EMBODIMENTS

Figure 1:
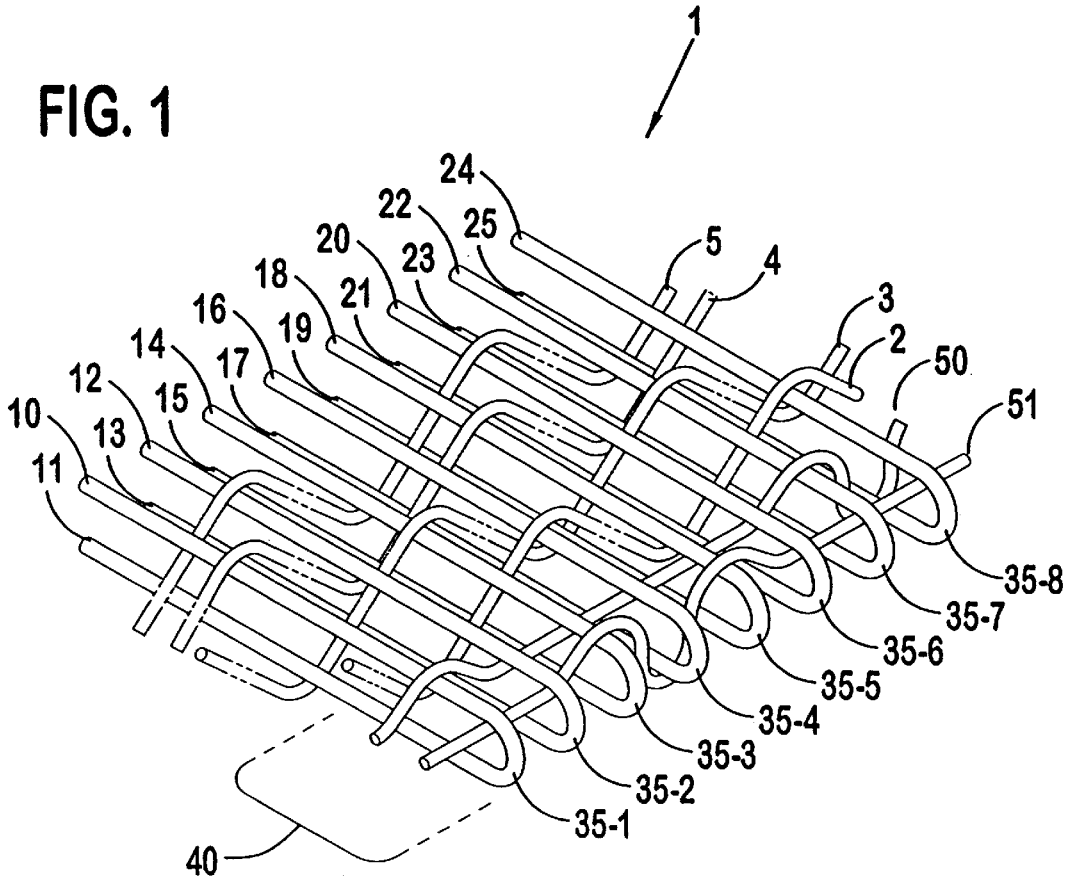
FIG. 1 shows a portion of the longitudinal seam loops in a fabric having additional cross machine direction threads in accordance with the present invention.
Figure 2:
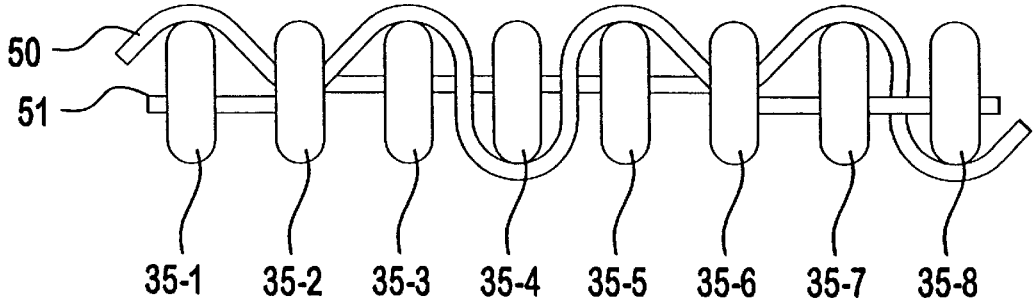
FIG. 2 is a front elevation of the seam loops and additional threads shown in FIG. 1.

The preferred embodiments will be described with reference to the drawing figures wherein like numerals represent like elements throughout.

Referring to FIG. 1, it shows a portion of the base fabric seam loops with additional threads woven in accordance with the present invention. The base fabric 1 comprises a top layer of MD longitudinal threads, 10, 12, 14, 16, 18, 20, 22, and 24, and a bottom layer of MD longitudinal threads, 11, 13, 15, 17, 19, 21, 23 and 25. It will be understood that the top and bottom layers are essentially continuous threads which form the seam loops 35-1 to 35-8 between the top and bottom layers. Typically, the phantom CMD threads 2–5 are interwoven with the top and bottom MD longitudinal threads in a given repeat pattern to form the body of the fabric. The weave of the body of the fabric forms no part of the present invention. A seam zone 40 exists between the final CMD thread 2 and the seam loops 35-1 to 35-8.

Figure 3:
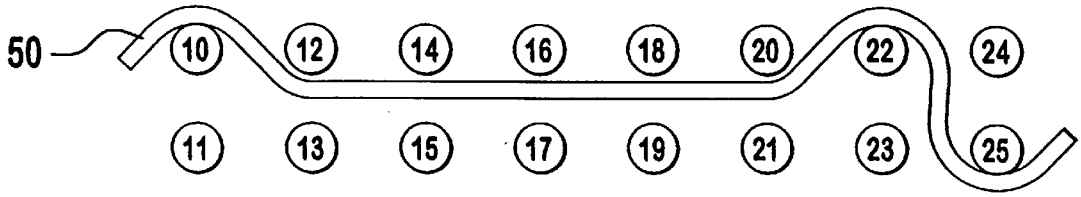
FIG. 3 illustrates one weave repeat pattern for one of the additional threads.
Figure 4:
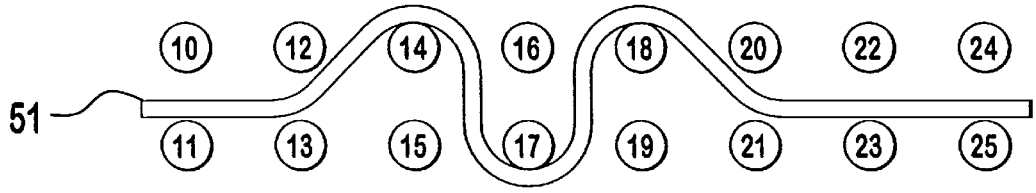
FIG. 4 illustrates one weave repeat for a second additional thread.
Figure 5:
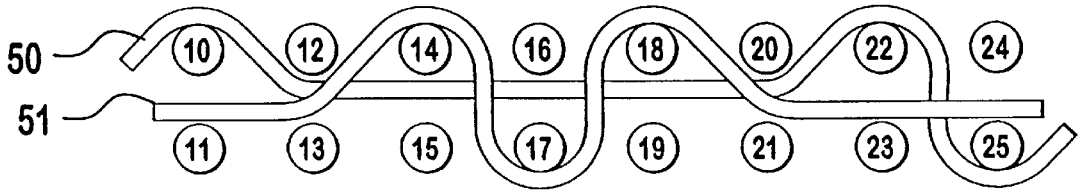
FIG. 5 shows the weave repeats of FIGS. 3 and 4 combined but without the seam loops as shown in FIG. 2.

Reference is now made to FIGS. 3, 4 and 5. Although some benefits will be obtained with a single additional thread, the preferred embodiments employ two additional threads for more uniformity in the paper side surface. The two additional CMD threads 50 and 51 are interwoven in the seam zone 40 with both layers of MD threads 10 through 25. Additional CMD thread 50 preferably weaves in a repeat pattern that passes over MD threads 10–11, between MD thread pairs 12–13, 14–15, 16–17, 18–19, 20–21, over threads 22–23 and under MD threads 24–25. With reference to FIG. 4, the second additional thread 51 is woven in a complementary pattern to that of the thread 50. The CMD thread 51 weaves in a repeat that passes between thread pairs 10–11, 12–13, over threads 14–15, under threads 16–17, over threads 18–19 and between thread pair 20–21, 22–23, 24–25.

Figure 6:
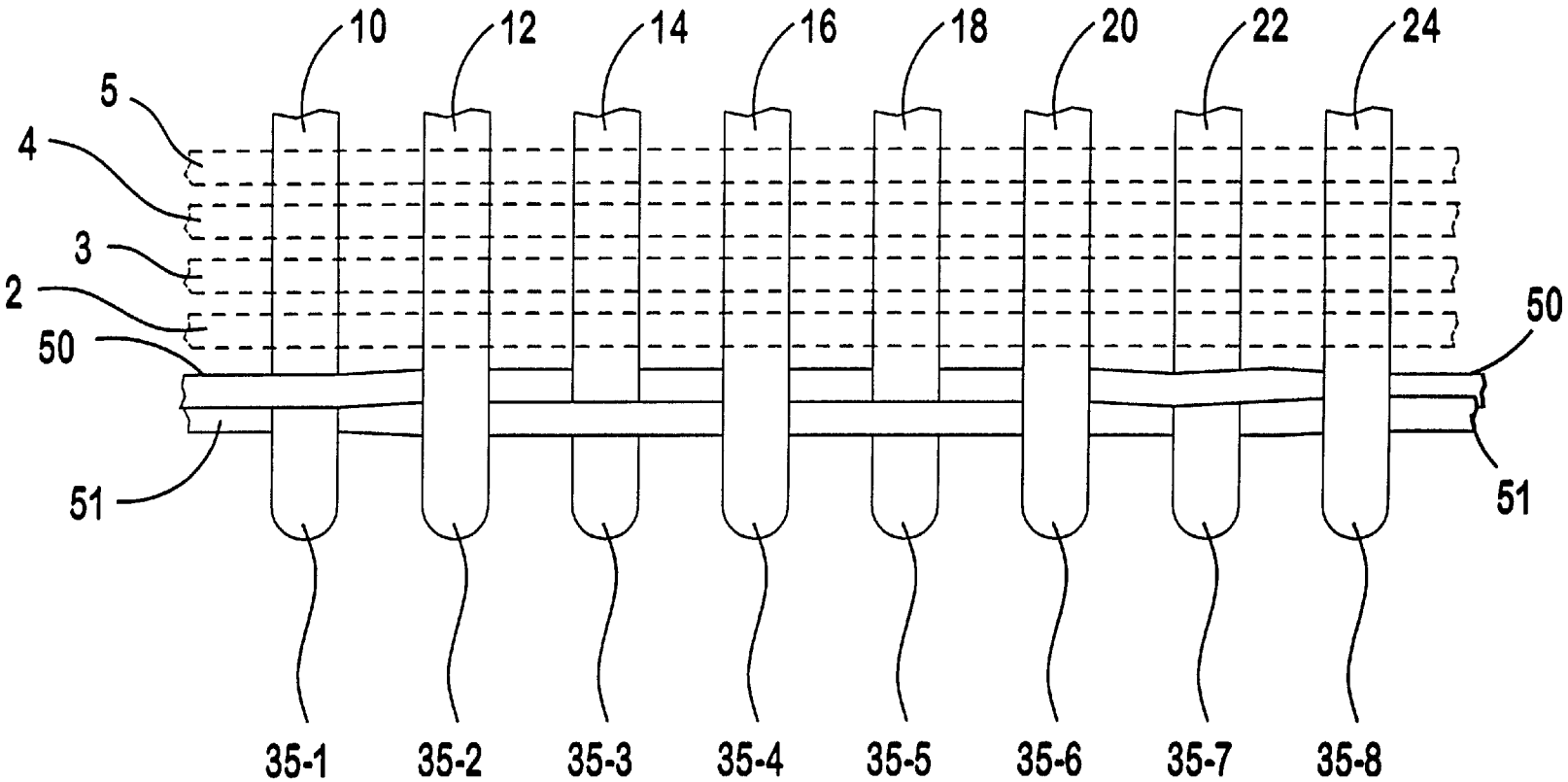
FIG. 6 is a top plan view of the combined weave patterns as illustrated in FIGS. 1, 2 and 5.

The complementary pattern of the repeats can be seen from FIG. 5. From FIG. 5 it can be seen that the shifted weave repeats of threads 50 and 51 result in a transverse weave repeat that appears as a plain weave on the paper side surface of the fabric, and a mid-plane float between each MD pair 10–11, 12–13, 14–15, 16–17, 18–19, 20–21, 22–23, and 24–25 of the repeat. Finally, these weave repeats result in minimum interlacings on the machine side of the fabric. This allows the mid-plane floats to migrate relative to one another, thereby effectively creating a virtually continuous mid-plane float across the width of the fabric, see FIG. 6. This is particularly beneficial in two-layer fabric constructions.

Figure 7:
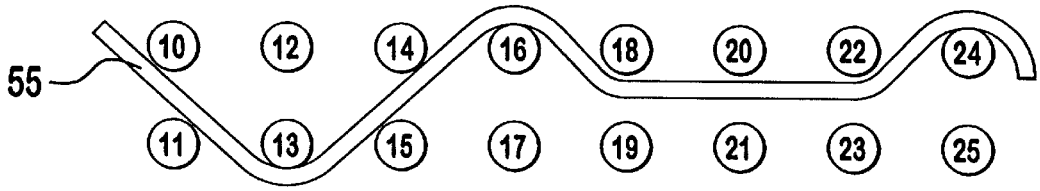
FIG. 7 illustrates the weave repeat for one additional thread in accordance with a second embodiment.
Figure 8:
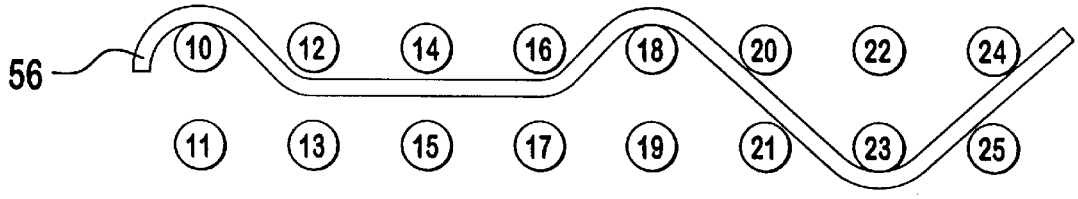
FIG. 8 illustrates the weave repeat for a second additional thread in accordance with the second embodiment.
Figure 9:
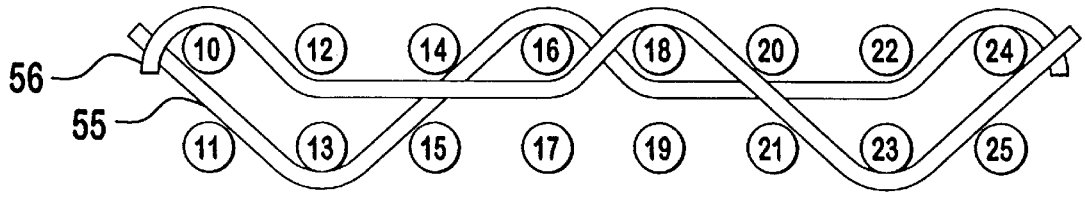
FIG. 9 shows the weave repeats of FIGS. 7 and 8 in combination.

With reference to FIGS. 7, 8 and 9, there is shown a second embodiment of the present invention. In this embodiment, the transverse additional thread 55 weaves between MD threads 10–11, under MD threads 12–13, between MD threads 14–15, over MD threads 16–17, between MD thread pairs 18–19, 20–21, 22–23 and over MD threads 24–25. The additional transverse thread 56 weaves in a complementary pattern. Thread 56 weaves over MD threads 10–11, between MD thread pairs 12–13, 14–15, 16–17, over MD threads 18–19, between MD threads 20–21, under MD threads 22–23, and between MD threads 24–25. As can be seen from FIG. 9, these complementary weave patterns produce a sheet side weave pattern with pairs of transverse weave knuckles alternating with pairs of MD threads that are over both of the additional transverse threads 55 and 56. In addition to producing long continuous mid-plane floats, these patterns also increase the thread's transition length as it passes from layer to layer. Here, the threads 55 and 56 transition under three sheet side MD threads while passing under only one machine side MD thread. This embodiment provides minimum machine side surface interlacings, and long transitions that appear to provide a continuous a mid-plane float between six of the eight MD pairs.

Figure 10:
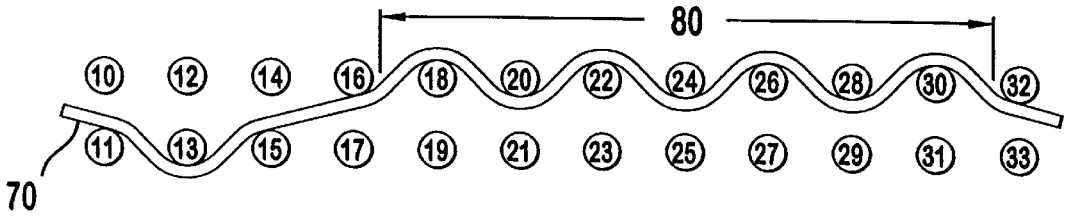
FIG. 10 illustrates the weave repeat for one additional thread in accordance with a third embodiment.
Figure 11:
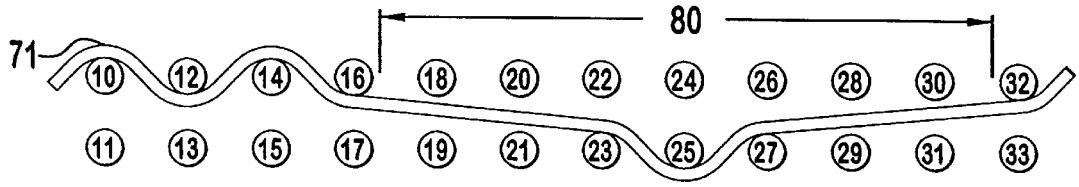
FIG. 11 illustrates the weave repeat for a second additional thread in accordance with the third embodiment.
Figure 12:
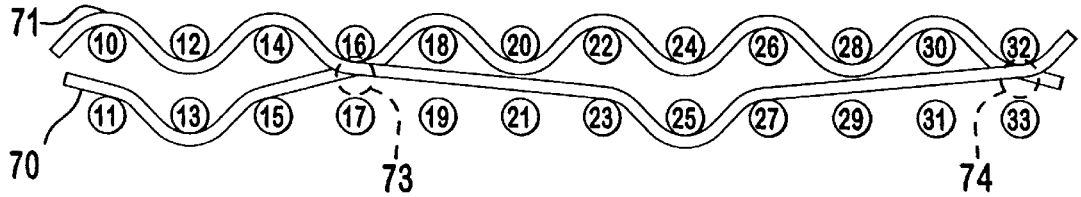
FIG. 12 shows the weave repeats of FIGS. 10 and 11 in combination.

A third embodiment of the present invention is shown in FIGS. 10–12. The fabric of this embodiment repeats on twenty four MD threads 10–33. The two additional threads 70 and 71 are interwoven in the seam zone 40 with both layers of longitudinal threads 10 through 33. Additional CMD thread 70 weaves in a repeat pattern that passes between MD threads 10–11, under MD threads 12–13, between MD thread pairs 14–15, 16–17, and then weaves a continuous portion of plain weave with top layer MD threads 18, 20, 22, 24, 26, 28,30 before transitioning down between MD threads 32–33. With reference to FIG. 11, the second additional thread 71 is woven in a complementary pattern to that of thread 70. Additional thread 71 weaves a plain weave construction with top layer threads 10, 12, 14 before transitioning into a mid-plane float between MD thread pairs 16–17,18–19, 20–21, 22–23 weaving under MD threads 24–25 and transitioning back to a mid-plane float between thread pairs 26–27, 28–29, 30–31, 32–33.

As can be seen from FIG. 12, two additional threads interwoven in accordance with FIGS. 10 and 11 produce a weave repeat structure having the appearance of a plain weave in the upper layer and two crossover points 73 and 74 which are spaced apart by at least three MD threads. This results from the additional longitudinal thread being in a continuous portion 80 of the weave repeat with seven adjacent MD threads between transitions from the machine or paper side longitudinal threads. Since the repeat pattern extends over twelve pairs of MD threads with only a single interlacing in the machine side MD layer and the additional threads can shift relative to each other, threads 70 and 71 tend to act as one thread in a continuous plain weave on the top layer. As a result of the long transitions and the interlacing patterns, the additional threads can migrate relative to each other to produce the desired sheet side weave pattern while also providing mid-plane floats and long transitions. The combined threads provide two mid-plane floats, each floating between five of six MD thread pairs.

Figure 13:
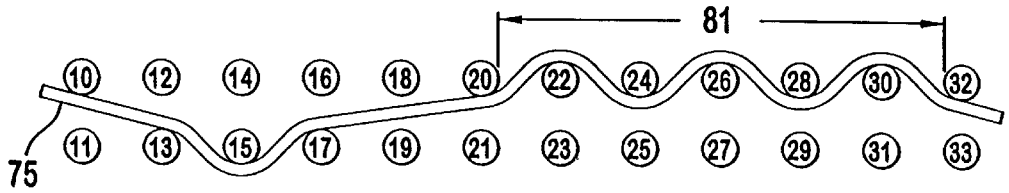
FIG. 13 illustrates the weave repeat for one additional thread in accordance with a fourth embodiment.
Figure 14:
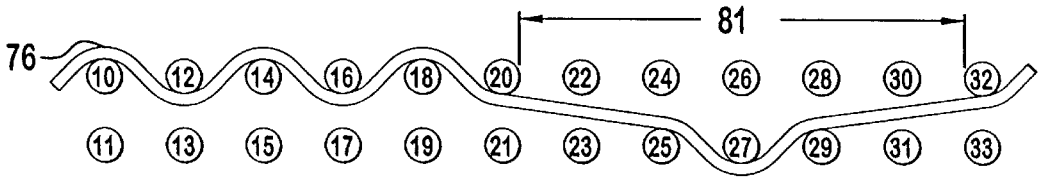
FIG. 14 illustrates the weave repeat for a second additional thread in accordance with the fourth embodiment.
Figure 15:
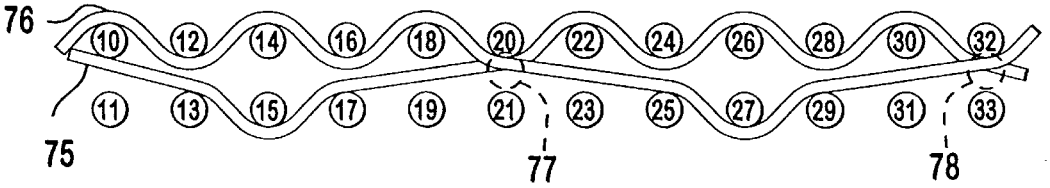
FIG. 15 shows the weave repeats of FIGS. 13 and 14 in combination.

With reference to FIGS. 13–15, there is shown a fourth embodiment of the present invention. In this fourth embodiment, the first additional thread 75 weaves between MD thread pairs 10–11, 12–13, beneath MD threads 14–15, between MD thread pairs 16–17, 18–19, 20–21, and then in a plain weave repeat with the upper layer MD threads 24, 26, 28, 30, 32. The second additional thread 76 weaves in the mirror image of thread 75. As shown by FIG. 15, the threads 75 and 76 produce a plain weave pattern on the paper sheet side, relatively long transitions which combine in a virtual mid-plane float and widely spaced crossover points 77, 78 which encourage migration of the threads relative to each other. As with the prior embodiment, this embodiment provides a continuous portion 81 of the weave repeat that extends over at least five adjacent paper side longitudinal threads between transitions from the machine or paper side longitudinal threads and two mid-plane floats, each floating between five of six MD thread pairs.

Figure 16:
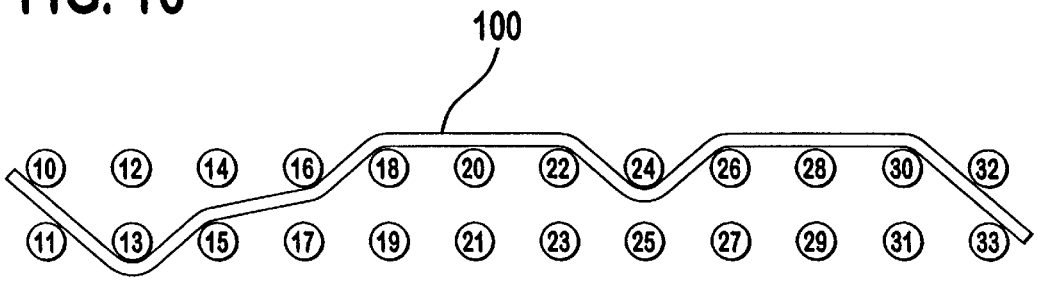
FIG. 16 illustrates the weave repeat for one additional thread in accordance with a fifth embodiment.
Figure 17:
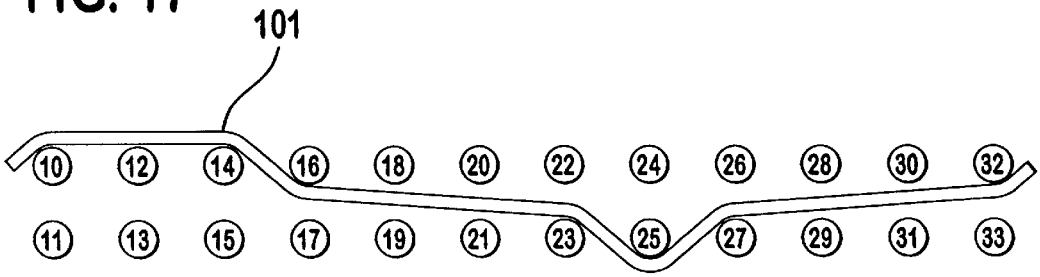
FIG. 17 illustrates the weave repeat for a second additional thread in accordance with the fifth embodiment.
Figure 18:
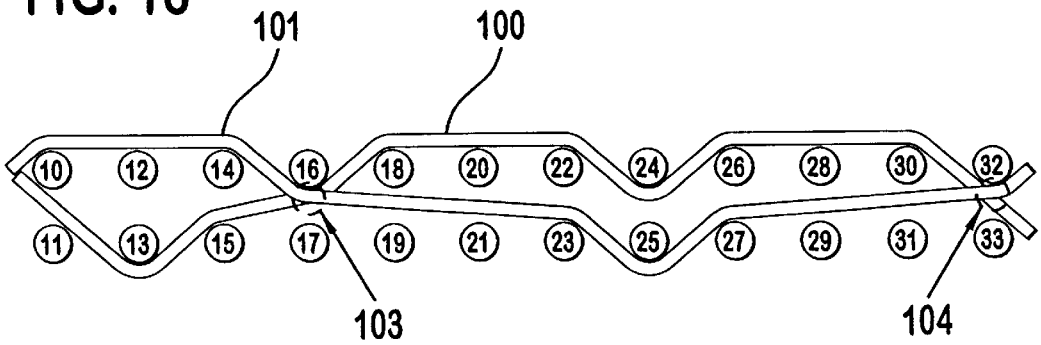
FIG. 18 shows the weave repeats of FIGS. 16 and 17 in combination.

Referring to FIGS. 16–18, a fifth embodiment is shown. Additional CMD thread 100 weaves in a repeat pattern that passes between MD threads 10–11, under MD threads 12–13, between MD thread pairs 14–15, 16–17, floats over MD threads 18–23, between MD threads 24–25, floats over MD threads 26–31 and between MD threads 32–33. With reference to FIG. 17, the second additional thread 101 is woven in a complementary weave pattern to that of thread 100. Additional thread 101 weaves over MD threads 10–15, between MD thread pairs 16–17, 18–19, 20–21, 22–23, under MD threads 24–25 and between MD thread pairs 26–27, 28–29, 30–31, 32–33. It will be noted from FIG. 17 that additional thread 101 forms two mid-plane floats between four pairs of MD threads 16–17, 18–19, 20–21, 22–23 and 26–27, 28–29, 30–31, 32–33.

As can be seen from FIG. 18, the two additional threads 100,101 as interwoven in FIGS. 16 and 17 produce a weave repeat structure having the appearance of an over three, under one repeat in the upper layer. The two crossover points, 103, 104 are spaced apart by at least three MD threads. This creates a long continuous portion of the second additional thread 101 which generally forms mid-plane floats that complement the long transition of the first additional thread 100. Since the repeat pattern extends over twelve pairs of MD threads with only a single interlacing in the machine side MD layer and the additional threads can shift relative to each other, threads 100 and 101 tend to act as one thread in a continuous over three, under one weave pattern on the top layer. With reference again to FIG. 16 and additional thread 100, it can be seen that the weave repeat of thread 100 includes a subrepeat of over three, under one which repeats twice within the pattern. This weave repeat permits the relatively loose interlacing of the thread 101 but enables the pattern to be continued throughout the upper layer when the threads 100, 101 are combined in accordance with FIG. 18. Again, the combined threads 100, 101 provide two mid-plane floats, each floating between five of six MD thread pairs.

Figure 19:
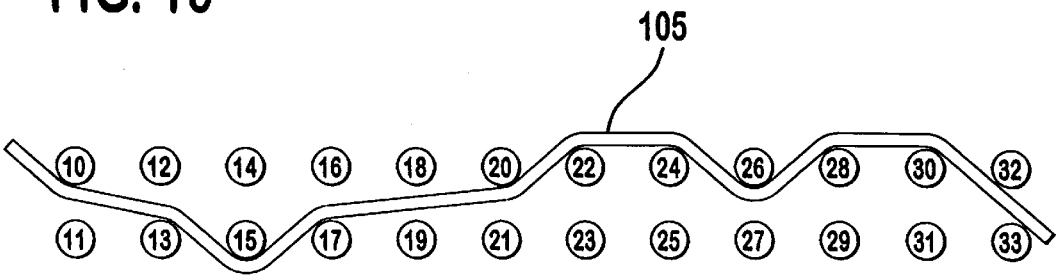
FIG. 19 illustrates the weave repeat for one additional thread in accordance with a sixth embodiment.
Figure 20:
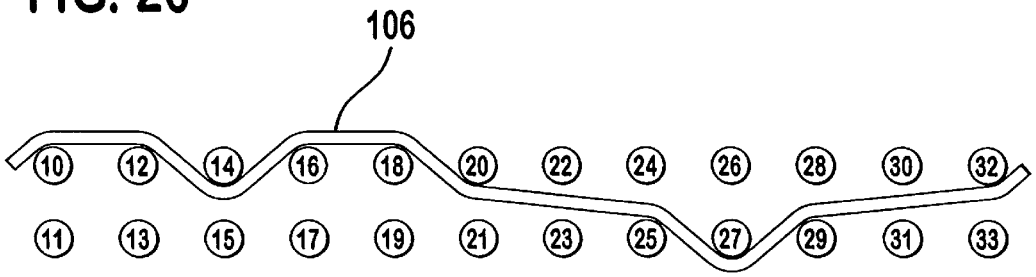
FIG. 20 illustrates the weave repeat for a second additional thread in accordance with the sixth embodiment.
Figure 21:
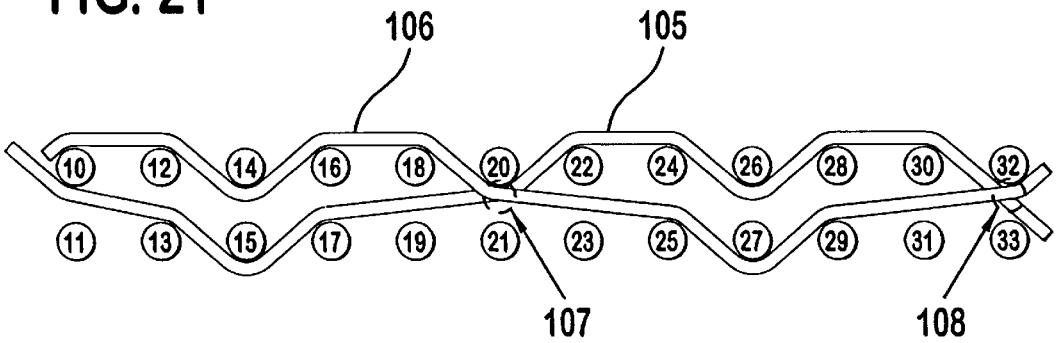
FIG. 21 shows the weave repeats of FIGS. 19 and 20 in combination.

With reference to FIGS. 19–21, there is shown a sixth embodiment of the present invention. In this sixth embodiment, the first additional thread 105 weaves between MD thread pairs 10–11, 12–13, beneath MD threads 14–15, between MD thread pairs 16–17, 18–19, 20–21 and then in two repeats of the subrepeat pattern of over two, under one with upper MD threads 22, 24, 26, 28, 30, 32. The second additional thread 106 weaves in the mirror image of thread 105. As shown by FIG. 21, the threads 105 and 106 produce an over two, under one weave pattern on the paper sheet side, relatively long transitions in virtual five thread mid-plane floats and crossover points 107,108 which encourage migration of the threads relative to each other. As with the prior embodiment, this embodiment provides a weave repeat that includes two repeats of the subrepeat in adjacent paper side longitudinal threads between the transitions from the machine or paper side longitudinal threads.

It will be appreciated that batt adhesion to the additional thread(s) of the various embodiments will be most improved on the sheet side surface but that improved machine side batt adhesion will be achieved.

The additional CMD threads 50, 51, 55, 56; 70, 71, 75, 76, 100, 101, and 105, 106 can be multifilament, spun, braided, knitted, or bicomponent. If the thread is of a bicomponent nature, the bicomponent material may have a core material with a higher melting point surrounded by a covering of a lower melting point material. This allows the covering to melt and adhere to the batt material during finishing without affecting the core structure of the thread. Threads may be made from polymeric resins selected from a group consisting of polyamide, polyurethanes, polyesters, polyaramids, polyimides, polyolefins, polyetherketones, polypropylenes, PET, PBT, PTT, phenolics, and copolymers thereof.

What is claimed is:

1. An open ended papermaker's fabric having interwoven longitudinal and transverse thread systems, a paper side, a machine side, a plurality of seam loops at each end of the fabric formed by the threads of the longitudinal thread system, and a seam zone at each end of said fabric between the respective seam loops and a respective end thread of said transverse thread system, the fabric characterized by:

at least one additional transverse thread interwoven in at least one seam zone with the longitudinal thread system in a repeat pattern that includes a mid-plane float that extends between at least two pairs of paper side and machine side longitudinal threads.

2. An open ended papermaker's fabric having interwoven longitudinal and transverse thread systems, a paper side, a machine side, a plurality of seam loops at each end of the fabric formed by the threads of the longitudinal thread system, and a seam zone at each end of said fabric between the respective seam loops and a respective end thread of said transverse thread system, the fabric characterized by:

two additional transverse threads interwoven in at least one seam zone with the longitudinal thread system, each of the two additional threads woven in a repeat pattern that includes at least a first mid-plane float between at least two pairs of paper side and machine side longitudinal threads.

3. The fabric of claim 2 wherein the first mid-plane float of each additional thread is shifted in the transverse direction relative to the first mid-plane float of the other additional thread.

4. The fabric of claim 2 wherein the first mid-plane float of each additional thread is shifted in the transverse direction relative to the first mid-plane float of the other additional thread by at least four paper side longitudinal threads.

5. The fabric of claim 2 wherein the repeated pattern of one of the additional threads includes two mid-plane floats between at least two pairs of paper side and machine side longitudinal threads.

6. The fabric of claim 2 wherein the paper side floats of the first and second additional threads combine to float between at least seventy-five percent of the pairs of paper side and machine side longitudinal threads.

7. The fabric of claim 2 wherein the paper side floats of the first and second additional threads combine to float between each of the pairs of paper side and machine side longitudinal threads.

8. The fabric of claim 2 wherein the additional threads migrate relative to one another such that a portion of one of the additional threads overlies a portion of the other additional thread.

9. The fabric of claim 8 wherein the mid-plane floats of the first and second additional threads combine to float between each of the pairs of paper side and machine side longitudinal threads whereby a virtual continuous mid-plane float between each of the pairs of paper side and machine side longitudinal threads is defined.

10. A method of producing a papermaker's fabric comprising the steps of:

interweaving longitudinal and transverse thread systems in a base fabric having a body portion with first and second ends and paper and machine sides;

forming a plurality of seam loops at each end of the body from the longitudinal thread system;

defining a seam zone at each end of said fabric between a respective end thread of said transverse thread system in the body and respective seam loops; and interweaving at least one additional transverse thread in at least one seam zone with the longitudinal thread system in a repeated pattern having a mid-plane float of at least two longitudinal threads.

11. The method of claim 10 further comprising the step of interweaving a second additional transverse thread in the at least one seam zone in a repeated pattern having a mid-plane float of at least two longitudinal threads.

* * * * *